United States Patent [19]

Nakao et al.

[11] Patent Number: 4,646,451

[45] Date of Patent: Mar. 3, 1987

[54] STEAM IRON WITH A REMOVABLE WATER TANK

[75] Inventors: Kiyoshi Nakao; Kazuaki Husayasu; Shozi Iwasaki, all of Tottori, Japan

[73] Assignee: Sanyo Electric Co., Ltd., Osaka, Japan

[21] Appl. No.: 850,451

[22] Filed: Apr. 11, 1986

[30] Foreign Application Priority Data

Apr. 15, 1985 [JP] Japan ..... 60-795617
Aug. 29, 1985 [JP] Japan ..... 60-131842[U]

[51] Int. Cl.[4] ..... D06F 75/16; D06F 75/34; D06F 75/36

[52] U.S. Cl. ..... 38/77.3; 38/77.8; 38/89; 38/90

[58] Field of Search ..... 38/77.3, 77.8, 89, 90, 38/91, 92

[56] References Cited

U.S. PATENT DOCUMENTS 3,413,741 12/1968 Schwartz, Jr. et al. ..... 38/77.3
3,949,499 4/1976 Schaeffer et al. ..... 38/77.3
4,578,884 4/1986 Nakao ..... 38/77.3

FOREIGN PATENT DOCUMENTS 2488296 2/1982 France ..... 38/77.3

*Primary Examiner*—Werner H. Schroeder
*Assistant Examiner*—Andrew M. Falik
*Attorney, Agent, or Firm*—Beveridge. DeGrandi & Weilacher

[57] ABSTRACT

A steam iron comprising a base incorporating a heater, a heat-insulating cover which covers the top surface of the base, a handle unit connected to the heat-insulating cover at its rear portion, and a water tank mounted on the top front portion of the heat-insulating cover capable of being removed forward. The handle unit and the heat-insulating cover forming a water-tank housing space, of which the front and the both lateral sides are opened. The rear portion of the housing space where the handle unit is connected to the heat-insulating cover is narrowed as compared with the front-opening of the housing space. The housing space is so formed as to guide the water tank. By pushing the water tank along the housing space in a straight line, the water tank can be smoothly mounted.

11 Claims, 10 Drawing Figures

STEAM IRON WITH A REMOVABLE WATER TANK

BACKGROUND OF THE INVENTION

The present invention relates to a steam iron having a water tank which can be mounted on and removed from the iron body.

In a steam iron having a water tank removably mounted on the iron body from its front portion, the tank removed from the iron body can be independently handled, thus facilitating the supply of water to the tank or the discharge of the residual water in the tank. The tank can be made of synthetic resin or the like. The tank can therefore be made light in weight, so that the gross weight of the entire iron can be advantageously reduced.

A conventional steam iron of such type, for example, as shown in the Japanese Utility Model Laid-Open Publication No. 48389/1984 and the Japanese Patent Laid-Open Publication No. 171594/1984, the water tank mounted on a heat-insulating cover is engaged by engagement means disposed at the front end of a holding portion of a grip. In order to mount the above water tank on the iron body, it is required to insert a rib projecting from the bottom of the water tank, into an opening on the heat-insulating cover and thereafter to move the water tank toward the handle unit side, so that the water tank is engaged by the engagement means. Such structure disadvantageously makes it difficult to handle the water tank when mounting on the iron body. Moreover, the mounted water tank is vertically swung, thus giving a feeling of uneasiness to the operator. Further, in removing the water tank, a spring device on the top surface of the heat-insulating cover is used to push the water tank upward. Accordingly, when the engagement means are released, the water tank is suddenly pushed up to often frighten the operator. Such type of iron also has a defect that the water tank cannot be removed if fingers of the operator holding the handle unit partially touch the water tank. Further, after the water tank has been pushed up and removed from the iron body, the water tank may be placed incorrectly on the heat-insulating cover or the water tank is turned sideways at the side of the iron body if the amount of the water remaining in the water tank is small. Moreover, the spring device secured to the top surface of the heat-insulating cover which is heated to high temperatures, may be deformed or may not present sufficient resiliency over a long-term use. As a result, such spring device cannot push up the water tank if the tank is filled with a large amount of water.

In a steam iron where the heat-insulating cover is covered with the water tank, the water tank is often removed when the iron is used as a dry iron. Then, a radiant heat from the heat-insulating cover is applied directly to the hand of the operator holding the handle unit, thus giving an unpleasant feeling to the operator.

SUMMARY OF THE INVENTION

It is an object of the present invention to provide a steam iron in which a water tank can be easily mounted on a housing space between a heat-insulating cover and a handle unit with the housing space being utilized as a guide, and the top and the bottom surfaces of the water tank mounted on the iron main body and held by and between the heat-insulating cover and the handle unit to assure the stable housing of the water tank.

It is another object of the present invention to provide a steam iron capable of preventing radiant heat out of the heat-insulating cover from being applied to the hand of the operator when the iron is used as a dry iron with the water tank removed from the iron body.

It is further object of the present invention to provide a steam iron in which the water tank mounted on the housing space can be easily removed forward by releasing water-tank locking means which normally push the water tank forward when the water tank is mounted on the housing space.

In accordance with the present invention, the above objects are obtained by providing a steam iron comprising a base having a heater and an evaporation chamber communicating with steam jet holes, a heat-insulating cover which covers the top surface of the base and is provided at the top surface of the cover with a water pouring port communicating with the evaporation chamber, a handle unit connected to the heat-insulating cover at the top rear portion thereof, a covering portion disposed at the handle unit and forming, together with the top front portion of the heat-insulating cover, a housing space of which the front and the both lateral sides are opened, and a water tank removably housed in the housing space from the front thereof and having substantially the same shape as that of the housing space. The side shape of the housing space is formed so that the rear portion thereof where the handle unit is connected to the heat-insulating cover is narrowed in elevation as compared with the front opening of the housing space, and at least the rear portion of the housing space is inclined downward in a straight line. The water tank has at its bottom a nozzle adapted to communicate with the water pouring port in the heat-insulating cover when the water tank is housed in the housing space and fitted for the covering portion.

In the steam iron above-mentioned, the covering portion disposed at the handle unit may cover the heat-insulating cover in order to prevent the radiant heat out of the heat-insulating cover from being radiated to a holding portion which is disposed above the covering portion.

In the above-mentioned steam iron, there may be disposed a support post projecting toward the water tank, between the heat-insulating cover and the covering portion of the handle unit. The support post or the water tank may have a pressing member for normally pressing the water tank forward by a spring pressure. Between the water tank and the covering portion, there may be disposed lock means for preventing the water tank from being pushed out forward by the pressing member. This lock means can be formed, for example, by an engagement pin and an engagement groove adapted to be engaged with each other when the water tank is moved rearward along the heat insulating cover or the covering portion. The engagement pin may be so constructed as to be disengaged from the engagement groove when a slide lever provided at one lateral side of the water tank is pressed. A changeover lever for opening and closing the nozzle may be disposed at the other lateral side of the water tank where the slide lever is not being disposed. The changeover lever is preferably constructed so that the nozzle can be closed when the changeover lever is pressed.

According to the above-mentioned steam iron, the housing space which is formed between the heat-insulating cover and the handle unit and of which at least the rear portion is narrowed or inclined, in side elevation, downward in a straight line, can be utilized as a guide for inserting the water tank, so that the water tank can be easily housed. When the water tank is mounted, the top and the bottom surfaces of the water tank are held between the heat insulating cover and the handle unit, so that the water tank is maintained in a stable manner.

Moreover, in the steam iron having the covering portion which covers predetermined areas on the heat-insulating cover, the covering portion of the handle unit can intercept the heat radiated from the heat-insulating cover, thereby preventing the heat from being radiated above the covering portion when the iron is used as a dry iron with the water tank removed from the iron body. The operator can therefore use the iron without an unpleasant feeling with no radiation of heat from the heat-insulating cover to the hand of the operator holding the iron.

When the pressing member and the lock means are disposed in the above-mentioned steam iron, the water tank can be secured between the heat-insulating cover and the covering portion by the lock means. When the lock means is released, the water tank can be pushed out forward by the pressing member. When the lock means is constituted by the engagement pin and the above-mentioned engagement groove, the water tank can be locked merely by inserting the water tank into the housing space between the heat-insulating cover and the covering portion to engage the engagement pin with the engagement groove. When the engagement pin is so constructed as to be disengaged from the engagement groove by pressing the slide lever disposed at one lateral side of the water tank, the slide lever can be pressingly operated to release the water tank with the hand of the operator while holding the handle unit. And when the changeover lever is so constructed that the nozzle is closed when the changeover lever is pressed, the removal of the water tank and the closing operation of the nozzle can be simultaneously made by pressing at the same time both the slide lever and the changeover lever with the fingers while holding the holding portion with the hand of the operator. Such an operation is useful in preventing leakage of water in the water tank to the outside, such leakage occurring if it is failed to close the nozzle when the water tank is removed.

In accordance with the present invention, said another object is obtained by providing a steam iron comprising a base having a heater and an evaporation chamber communicating with steam jet holes, a heat-insulating cover which covers the top surface of the base, a handle unit connected to the heat-insulating cover at its top rear end, a covering portion disposed at the handle unit and forming, together with the heat-insulating cover at its top front portion, a housing space of which the front and the both lateral sides are opened, and a water tank removably mounted on the housing space from the front thereof for supplying water to the evaporation chamber. The above covering portion is located under a holding portion of the handle unit and has a width wider than that of the holding portion for covering the heat-insulating cover so as to shield the holding portion from radiant heat radiating from the heat-insulating cover.

According to the steam iron above-mentioned, the covering portion covers the heat-insulating cover, and when the iron is used as a dry iron with the water tank being removed, the covering portion can intercept the heat from the heat-insulating cover to prevent heat from being radiated toward the holding portion. The operator can therefore use the iron without an unpleasant feeling.

In accordance with the present invention, said further object is obtained by providing a steam iron comprising a base having a heater and an evaporation chamber communicating with steam jet holes, a heat-insulating cover which covers the top surface of the base, a handle unit connected to the heat-insulating cover at its top rear portion, and a water tank for supplying water to the evaporation chamber removably mounted on the top front portion of the heat-insulating cover from the front thereof. The handle unit has a covering portion which covers the upper portion of the water tank, a support post projecting toward the water tank being disposed between the heat-insulating cover and the covering portion of the handle unit, the support post or the water tank having a pressing member for normally pushing the water tank forward by a spring pressure, and lock means between the water tank and the covering portion for preventing the water tank from being pushed out forward by the pressing member. The lock means may be constituted by an engagement pin and an engagement groove adapted to be engaged with each other when the water tank is moved rearward along the heat-insulating cover or the covering portion. The engagement pin may be so constructed as to be disengaged from the engagement groove by pressing a slide lever provided at one lateral side of the water tank.

A changeover lever for opening and closing a nozzle through which water in the water tank is supplied into the evaporation chamber may be disposed at the other lateral side of the water tank where the slide lever is not being disposed. It is preferred to construct the changeover lever so that the nozzle is closed when the changeover lever is pressingly operated.

According to the above-mentioned steam iron, the water tank can be locked between the heat-insulating cover and the covering portion by the lock means, and can be pushed forward by the pressing member when the lock means is released.

When the lock means is constituted by the engagement pin and the above-mentioned engagment groove, the engagement pin and the engagement groove can be engaged with each other to lock the water tank merely by inserting the water tank in the housing space between the heat-insulating cover and the covering portion. When the engagement pin is so constructed as to be disengaged from the engagement groove by pressing the slide lever at the front lateral side of the water tank, the slide lever can be pressingly operated to release the water tank with the hand of the operator while holding the handle unit. When the changeover lever is so constructed as to close the nozzle when the changeover lever is pressingly operated, the removal of the water tank and the closing operation of the nozzle can be simultaneously made by pressing at the same time both the slide lever and the changeover lever with the fingers while holding the holding portion with the hand of the operator. Such operation is useful in preventing leakage of water in the water tank to the outside, such leakage occuring if the nozzle isn't closed when the water tank is removed.

These and other objects of the present invention will be apparent from the following description with reference to the accompanying drawings.

DETAILED DESCRIPTION OF THE PREFERRED EMBODIMENTS

The invention will be described below in detail with reference to the accompanying drawings illustrating, by way of example, preferred embodiments of the steam iron in accordance with the invention.

Figure 1:
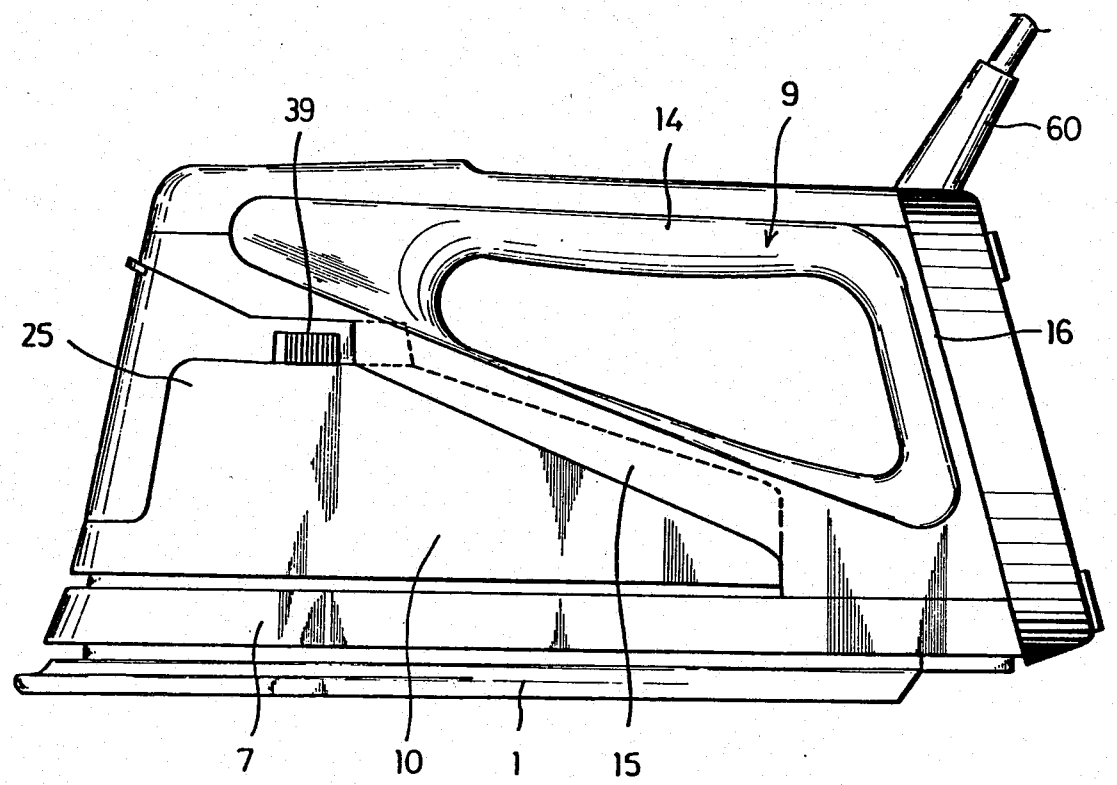
FIG. 1 is a side view of a steam iron in accordance with one embodiment of the present invention.
Figure 5:
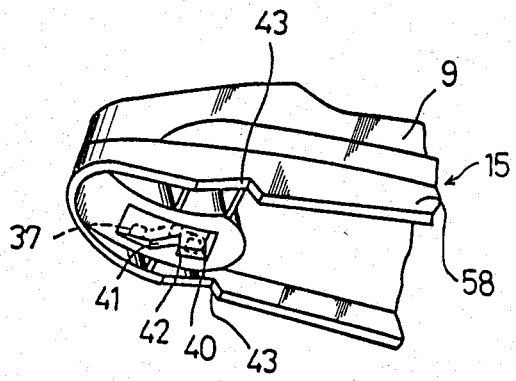
FIG. 5 is a perspective view of the front portion of a handle unit when viewed from the bottom.
Figure 7:
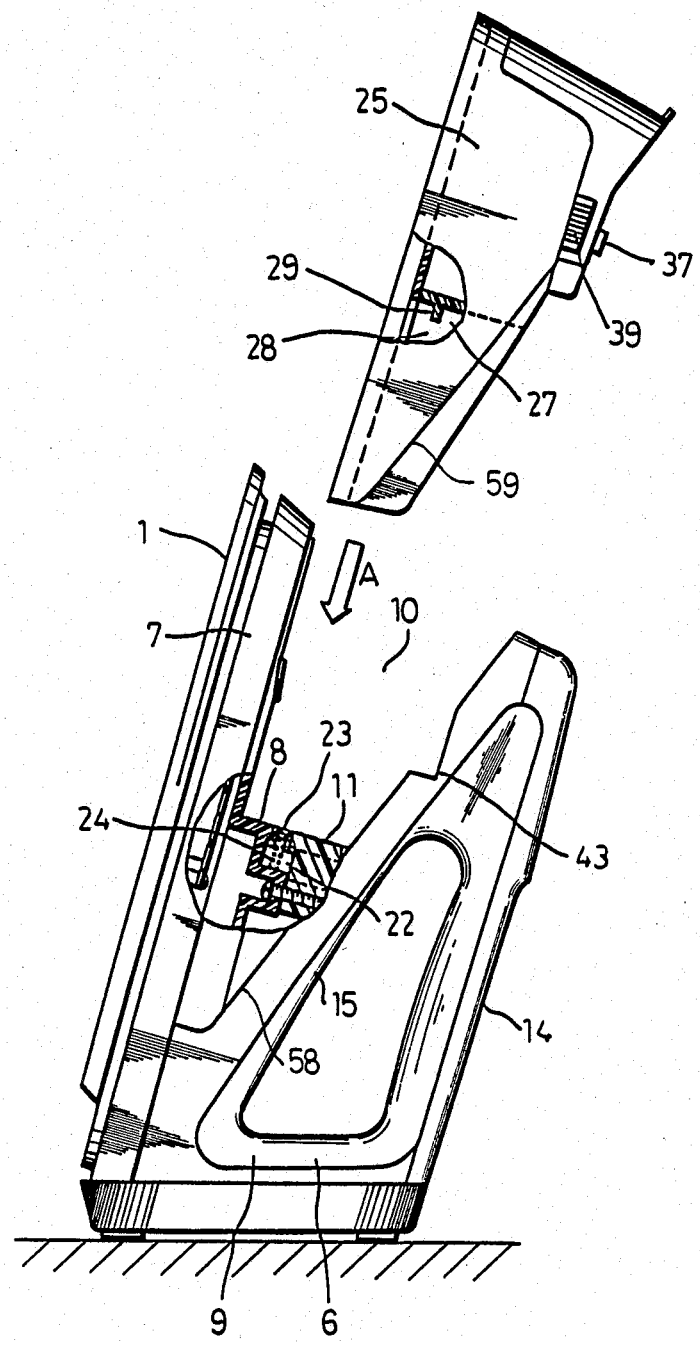
FIGS. 7 and 8 illustrate how the water tank is mounted on a housing space.

In FIG. 1, a heat-insulating cover 7 is secured to cover the top surface of a base 1 in which a heater is embedded. A handle unit 9 is secured to the heat-insulating cover 7 at its top rear portion. The handle unit 9 has a holding portion 14 for operating the iron, a covering portion 15 located under the holding portion 14 and having a width wider than that of the holding portion 14, and a support 16 for connecting the rear portion of the holding portion 14 and the covering portion 15 to each other. As shown in FIG. 5, the covering portion 15 has at the both lateral sides thereof a skirt portion 58 for reinforcing the covering portion 15 itself and for preventing a mounted water tank 25 from shaking. A housing space 10 is formed for housing the water tank 25 between the top surface of the heat-insulating cover 7 and the bottom surface of the covering portion 15. The side contours of the covering portion 15, the water tank 25 and the heat-insulating cover 7 are substantially the same. The top surface of the water tank 25 and the bottom surface of the covering portion 15 are both flat. As shown in FIG. 7, the water tank 25 has at the side rear portion thereof a step 59 also serving as a reinforcement for the water tank 25 itself. When the water tank 25 is mounted, the skirt portion 58 comes in contact with the step 59. The covering portion 15 has a bottom inclined by a predetermined angle with respect to the heat-insulating cover 7. In side elevation, the water tank 25 has a substantially triangular form which corresponds to the shape of the housing space 10. When the iron is viewed from the side, the handle unit 9 has substantially a triangular hollow portion in which the operator can insert the fingers. The iron has a power cord 60 and a STEAM/DRY changeover lever 39 at one lateral side of the front part of the water tank 25.

Figure 2:
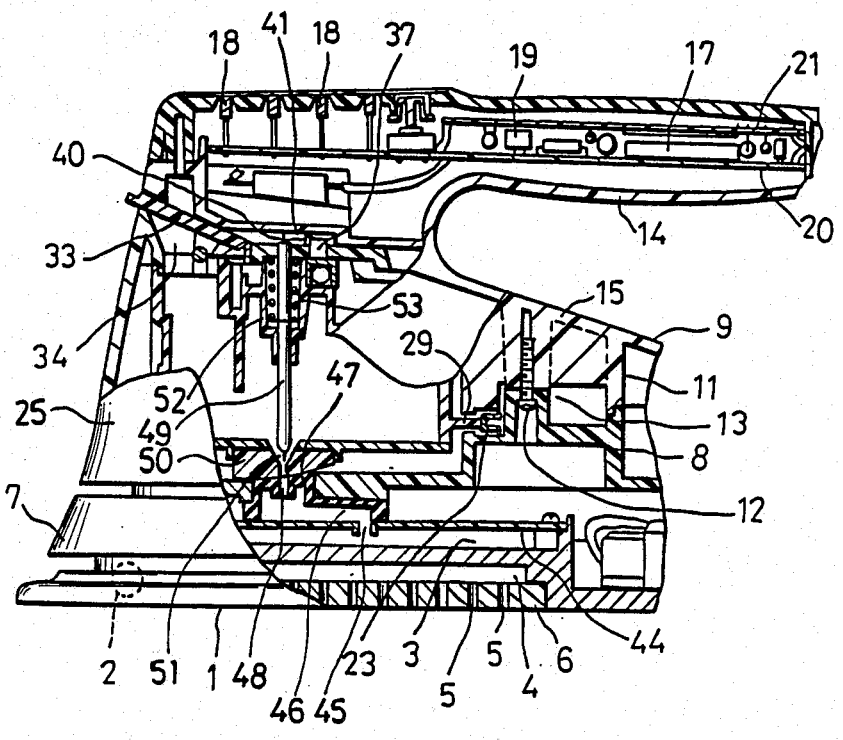
FIG. 2 is a partial sectional view of the steam iron in FIG. 1.

In FIG. 2, the base 1 incorporates a sheathed heater 2, on which an evaporation chamber 3 is formed. The base 1 has at the lower portion thereof a steam chamber 4 communicating with the evaporation chamber 3. The steam chamber 4 is covered, at the lower surface thereof, with a removable base lid 6 having a plurality of steam jet holes 5. The evaporation chamber 3 is covered, at the upper surface thereof, with an evaporation lid 44, which has a communication hole 45. On the top of the heat-insulating cover 7 is exposed a cylindrical packing 47 made of resilient material, for example a heat-resistant rubber. The communication hole 45 communicates with a water pouring hole 48 passing through the packing 47, through a space 46 above the evaporation lid 44.

The heat-insulating cover 7 has, at the top center portion thereof, a projection 8 projecting upward from the cover 7. The covering portion 15 has, at the bottom center portion thereof, a projection 11 projecting downward from the covering portion 15. The projections 8 and 11 are connected to each other with a screw 12, and form a support post 13.

The holding portion 14 has inside a hollow portion which incorporates printed circuit boards 20 and 21 on which are mounted control parts 17 for controlling the temperature of the heater 2. Also mounted on the printed circuit boards 20 and 21 are driving parts 19 for driving temperature indicators 18 which are disposed on the upper front surface of the holding portion 14.

Figure 3:
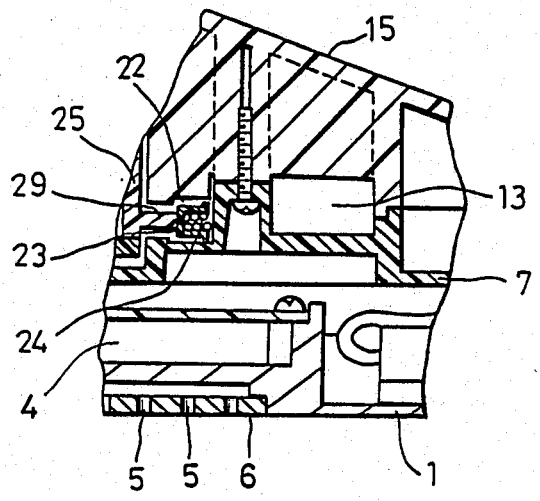
FIG. 3 is an enlarged sectional view of a portion of FIG. 2.

As shown in FIG. 3, a concave portion 22 having a small-diameter opening is formed on the support post 13 at the front surface thereof. This opening faces the housing space 10. A pressing member 23 is housed in the concave portion 22. The outer diameter of the rear portion of the pressing member 23 is slightly larger than the inner diameter of the opening of the concave portion 22, thus preventing the pressing member 23 from springing out of the concave portion 22. A spring 24 is disposed between the inner end of the concave portion 22 and the pressing member 23. By the spring 24, the pressing member 23 is normally pressed from the opening toward the front side of the housing space 10.

Figure 4:
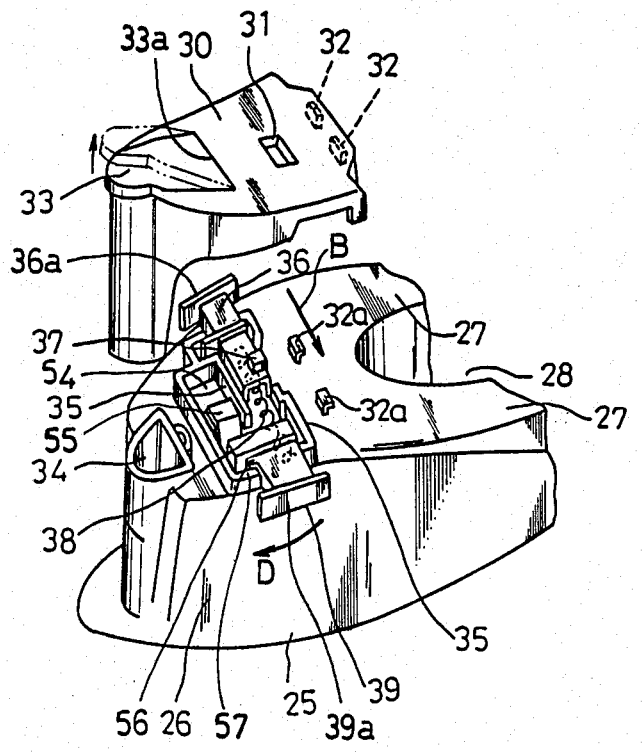
FIG. 4 is a perspective view of a water tank and a tank cover.

The water tank 25 is made of synthetic resin and has a U-shape in plan when viewed from above. As shown in FIG. 4, the water tank 25 has at the front top thereof a water inlet/outlet port 34, through which water can be supplied to housing chambers of the water tank 25. The housing chambers include a front housing chamber 26 of a relatively large volume and two rear housing chambers 27 at the both lateral sides of the water tank 25. The front housing chamber 26 communicates with the rear housing chamber 27.

As shown in FIG. 2, the water tank 25 is provided at the front bottom thereof with a projection 50 made of heat-resistant resin adapted to come in close contact with the packing 47 disposed at the top of the heat-insulating cover 7, when the water tank 25 is mounted. A nozzle 51 passes through the projection 50 and is adapted to communicate with the water pouring hole 48 when the water tank 25 is mounted on the housing space 10 and is fitted with the covering portion 15. A rod 49 is vertically suspended in the front housing chamber 26 of the water tank 25, the bottom end of which is located immediately above the nozzle 51. The nozzle 51 can be opened or closed by the vertical movement of the rod 49. The water in the water tank 25 can be supplied from the nozzle 51 to the evaporation chamber 3 through the water pouring hole 48.

Figure 8:
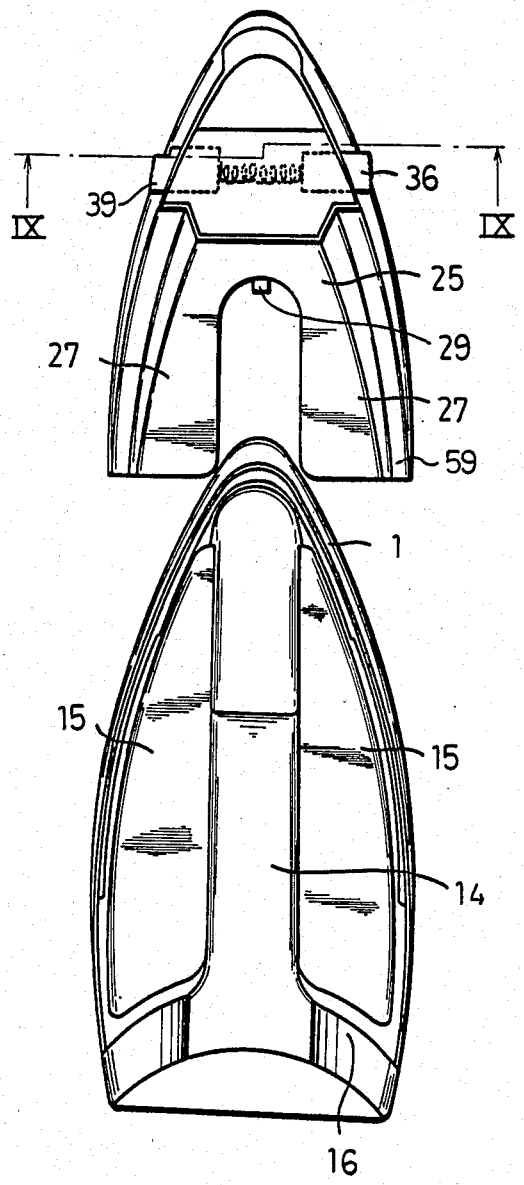

A concave portion 28 is formed between the rear housing chambers 27. As shown in FIGS. 7 and 8, a projection 29 projecting in the rear direction is disposed at the inner end of the concave portion 28. The projection 29 is formed integrally with the water tank 25.

As shown in FIG. 4, a tank cover 30 to be put on the upper portion of the water tank 25 has a slot 31 on the top surface thereof. Engagement pawls 32*a* on the top surface of the water tank 25 are engaged with engagement holes 32 in the tank cover 30 at the rear lower portion thereof, so that the tank cover 30 is secured to the water tank 25. The water tank cover 30 has at the front top thereof a lid 33 for opening and closing the water inlet/outlet port 34. By lifting and rotating the tip of the lid 33 around a hinge portion 33*a*, the water inlet/outlet port 34 can be opened. When the water tank 25 is housed in the housing space 10, the lid thus opened is pushed downward by the tip of the lower surface of the covering portion 15 so as to be automatically. closed.

On the portion of the top surface of the water tank 25 to be covered by the water tank cover 30, there are disposed a slide lever 36, the changeover lever 39 and guide rib 35 integrally formed with the water tank 25. The slide lever 36 and the changeover lever 39 are disposed on the opposite side of the guide rib 35. These levers can be slided, as guided by the guide rib 35, by the operation of the fingers of the iron operator. The slide lever 36 and the changeover lever 39 extend beyond the outer lateral sides of the guide rib 35 to end with switching buttons 36*a* and 39*a*, respectively, which are exposed to the outside. Accordingly, the operator can pressingly operate the levers 36 and 39 by holding these levers 36 and 39 by and between the fingers of the hand, while the holding portion 14 of the handle unit 9 is held with the hand.

The slide lever 36 has on the top surface thereof an engagement pin 37 which passes through the slot 31, the pin 37 being integrally formed with the slide lever 36. A compression spring 38 between the levers 36 and 39 pushes the slide lever 36 and hence the engagement pin 37 to project outward.

Figure 9:
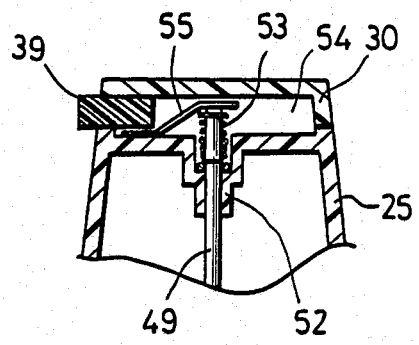
FIG. 9 is a sectional view taken along the line IX—IX of FIG. 8.

As shown in FIG. 9, the upper end of the rod 49 for opening and closing the nozzle 51 is suspended in the front housing chamber 26 of the tank 25 by a support 52 integrally formed with the water tank 25. The upper end of the rod 49 projects in a space 54 defined by the aforementioned guide rib 35 formed between the water tank 25 and the tank cover 30. The rod 49 is normally pushed upward by a spring 53 which is put on the rod 49 at the upper end thereof. The upper end of the rod 49 is pushed by a leaf spring 55 disposed in an inclined manner on the top surface of the tank 25. The lower end of the leaf spring 55 extends under the changeover lever 39.

Accordingly, when the changeover lever 39 is pushed in the inside of the guide rib 35 against the restoring force of the spring 38, the leaf spring 55 is pushed down by the changeover lever 39. The upper end of the rod 49 can therefore be pushed down against the restoring force of the spring 53. The lower end of the rod 49 securely closes the nozzle 51 disposed at the bottom of the water tank 25, thereby to prevent the water in the water tank 25 from reaching the evaporation chamber 3 on the base 1 through the nozzle 51 and the water pouring hole 48. With these operations, the iron of the invention can be used as a dry iron.

When the changeover lever 39 is moved in the direction of an arrow D in FIG. 4 after it has been pushed, an engagement piece 56 integrally formed with the changeover lever 39 is engaged with an engagement pawl 57 which is integral with the guide rib 35 and projects toward the engagement piece 56. The changeover lever 39 is thus locked, so that the nozzle 51 is held as closed by the rod 49.

When the changeover lever 39 is released, the changeover lever 39 is reset to the original position by the restoring force of the spring 38. The holding-down state of the rod 49 by the leaf spring 55 is then released. The rod 49 can therefore be reset to the upper position by the restoring force of the spring 53. The nozzle 51 is then opened to supply the water in the water tank 25 to the evaporation chamber 3. Thus, the iron of the invention can be used as a steam iron.

As described in the foregoing, the operator can lock the changeover lever 39 by pushing the changeover lever 39 and then moving the same forward with the hand with which the holding portion 14 is held. The operator can therefore easily switch the iron from the steam mode to the dry mode during the operation of the iron. For using the iron as a steam iron, it is merely required to release the lock of the changeover lever 39 by pulling the same toward the operator with the hand with which the holding portion 14 is held. Thus, the iron can be easily reset to the steam mode.

Figure 6:
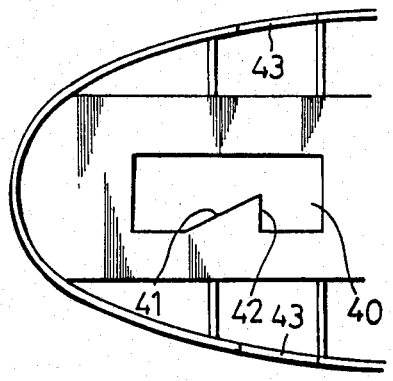
FIG. 6 illustrates an engagement groove.

As shown in FIG. 5, the covering portion 15 of the handle unit 9 has in the lower front thereof a rectangular engagement groove 40 extending in the longitduinal direction. As apparent from FIG. 6, the engagement groove 40 has in the inner wall a taper 41 which increasingly projects from the front side to the rear side. The taper 41 has at the rear end thereof a step 42. The above-mentioned engagement pin 37 integrally formed with the slide lever 36 is engaged with the step 42. Thus, the engagement pin 37 and the engagement groove 40 form locking means for locating the water tank 25 to the housing space 10.

The covering portion 15 of the handle unit 9 has, at the edge of the lower front thereof, notches 43 for housing the slide lever 36 and the changeover lever 39.

The following description will discuss how the water tank 25 is mounted and removed.

For mounting the water tank 25, the water tank 25 can be gradually inserted into the housing space 20 by horizontally moving the water tank 25 in the direction of an arrow A in FIG. 7 while, for example, the bottom of the water tank 25 is slid along the top surface of the heat-insulating cover 7. In such operation, the step 59 of the water tank 25 is guided by the skirt 58 formed at the lower end of the covering portion 15, thus permitting the water tank 25 to be smoothly inserted into the housing space 10. When the water tank 25 is inserted up to a predetermined depth, the engagement pin 37 enters the engagement groove 40 and strikes against the taper 41 in the engagement groove 40. At this time, the inserted water tank 25 receives a resistive force. When the water tank 25 is further pushed in the direction of the arrow A, the engagement pin 37 is moved along the taper 41 as shown by a broken line in FIG. 5. With the movement of the engagement pin 37, the spring 38 is compressed in the direction of the arrow B in FIG. 4. When the engagement pin 37 passes over the step 42 of the taper 41, the engagement pin 37 is reset to the original position by the restoring force of the spring 38, so that the engagement pin 37 is engaged with the engagement groove 40. With these operations, the water tank 25 can be mounted on the housing space. At this time, the projection 29 of the water tank 25 pushes the pressing member 23 against the spring 24. By the reaction of the spring 24, the water tank 25 is pushed forward. However, as far as the engagement pin 37 is engaged with the engagement groove 40, the water tank 25 is prevented from springing out forward. Besides, the water tank 25 can also be mounted by inserting the tank 25 into the housing space 10 while sliding the top surface of the tank 25 on the bottom surface of the covering portion 15.

When the slide lever 36 is pressed in the direction of the arrow B in FIG. 4 against the pressing force of the spring 38 in a state that the water tank 25 is mounted, the engagement pin 37 comes off from the step 42. By the restoring force of the spring 24, the pressing member 23 pushes the water tank 25 forward through the projection 29. The water tank 25 is thus released forward along the top surface of the heat-insulating cover 7. The slide lever 36 can be easily pressed with the finger of the hand with which the holding portion 14 is held. When the slide lever 36 and the changeover lever 39 are simultaneously pressed by and between the fingers of one hand, the removal of the water tank 25 and the closing operation of the nozzle 51 can be made at the same time. Such simultaneous operation of the levers 36 and 39 is useful in preventing the leakage of the water in the water tank 25 to the outside through the nozzle 51, while such leakage might occur if it is failed to close the nozzle 51 when the water tank 25 is removed.

As discussed in the foregoing, the heat-insulating cover 7 or the covering portion 15 can serve as a guide for inserting the water tank 25, so that the water tank 25 can be easily mounted by merely moving it backward. When the water tank 25 is to be removed, there is no possibility of the operator's finger touching the water tank 25 to prevent the water tank 25 from being pushed out. The location of the spring 24 and the pressing member 23 remote from the base 1 or the heat-insulating cover 7, prevents the spring 24 and the pressing member 23 from being exposed to a high temperature. The spring 24 therefore can not lose its resiliency even after a long-term use.

Figure 10:
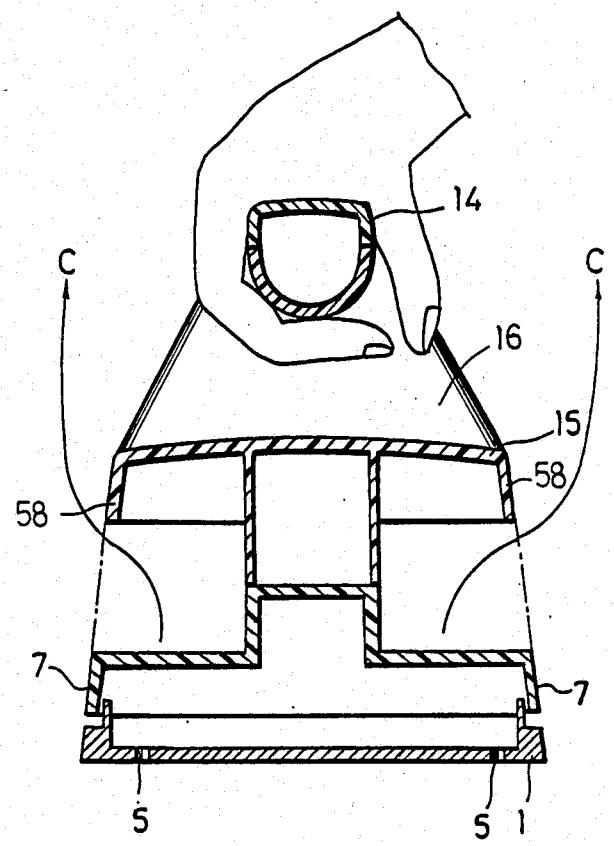
FIG. 10 illustrates a steam iron when it is operated.

Further, in the steam iron in accordance with the present invention, wherein the handle unit 9 has the covering portion 15, the radiant heat from the heat-insulating cover 7 can be intercepted by the covering portion 15, when the iron is used as a dry iron with the water tank 25 removed as shown in FIG. 10, thereby preventing radiant heat from the insulating cover 7 from being radiated directly to the hand with which the holding portion 14 is held. The provision of the skirt portion 58 of the covering portion 15 can further assure such interception of the radiant heat.

In the iron of the preferred embodiment, the projection 8 on the heat-insulating cover 7 and the projection 11 on the bottom of the handle unit 9 form the support post 13. However, such projection may not be formed on the top surface of the insulating cover and, instead, there can be formed at the handle-unit side a single projection which comes in contact with the top surface of the heat-insulating cover. Then, a support post can be formed only by this projection, at the front of which the pressing member can be disposed. On the contrary, a projection can be formed only at the side of the heat-insulating cover. Then, a support post can be formed by this projection, at the front of which the pressing member can be disposed.

While the description has been made in detail with reference to one specific embodiment of the steam iron in accordance with the present invention referring the accompanying drawings, it should be understood that the present invention is not limited to this embodiment. As to the housing space 10 for example, as far as the front portion of the housing space 10 is opened more widely than the rear portion thereof and at least the rear portion of the housing space 10 is inclined, in side elevation, downward in a straight line, the water tank 25 can be easily mounted. Also, the pressing member 23 can be disposed at the side of the water tank. Various modifications can be included in the present invention without departing from the scope thereof.

What is claimed is:

1. A steam iron comprising a base having a heater and an evaporation chamber communicating with steam jet holes provided on said base, a heat-insulating cover which covers the top surface of said base and is provided at the top surface of said cover with a water pouring port communicating with said evaporation chamber, a handle unit connected to said heat-insulating cover at the top rear portion thereof, a covering portion disposed at said handle unit and forming, together with said heat-insulating cover at the top front portion thereof, a housing space of which the front and the both lateral sides are opened, and a water tank removably housed in said housing space from the front thereof and having substantially the same shape as that of said housing space; the side shape of said housing space being formed so that the rear portion thereof where said handle unit is connected to said heat-insulating cover is narrowed in elevation as compared with the front opening of said housing space, and at least said rear portion of said housing space being inclined, in side elevation, downward in a straight line, and said water tank having at the bottom thereof a nozzle adapted to communicate with said water pouring port in said heat-insulating cover when said water tank is housed in said housing space and fitted for said covering portion.

2. A steam iron according to claim 1, wherein said covering portion disposed at the handle unit covers the heat-insulating cover in order to prevent the radiant heat out of the heat-insulating cover from being radiated toward a holding portion which is disposed above the covering portion.

3. A steam iron according to claim 1, wherein a support post projecting toward the water tank is disposed between the heat-insulating cover and the covering portion of the handle unit, a pressing member for normally pressing the water tank forward by a spring force is provided on said support post or said water tank, and lock means for preventing the water tank from being pushed out forward by said pressing member is disposed between the water tank and the covering portion.

4. A steam iron according to claim 3, wherein said lock means are constituted by an engagement pin and an engagement groove adapted to be engaged with each other when the water tank is moved rearward along the heat-insulating cover or the covering portion.

5. A steam iron according to claim 4, wherein said engagement pin is so constructed as to be disengaged from the engagement groove when a slide lever disposed at one lateral side of the water tank is pressed.

6. A steam iron according to claim 5, wherein a changeover lever for opening and closing the nozzle is disposed at the other lateral side of the water tank opposite to said one lateral side thereof where the slide lever is disposed, said nozzle being adapted to be closed when said changeover lever is pressingly operated.

7. A steam iron comprising a base having a heater an an evaporation chamber communicating with steam jet holes provided on said base, a heat-insulating cover which covers the top surface of said base, a handle unit connected to said heat-insulating cover at the top rear portion thereof, a covering portion disposed at said handle unit and forming, together with said heat-insulating cover at the top front portion thereof, a housing space of which the front and the both lateral sides are opened, and a water tank for supplying water to said evaporation chamber removably mounted on said housing space from the front thereof; said covering portion being located under a holding portion of said handle unit and having a width wider than that of said holding portion, thereby to cover said heat-insulating cover so as to shield said holding portion from radiant heat radiating from said heat-insulating cover.

8. A steam iron comprising a base having a heater and an evaporation chamber communicating with steam jet holes provided on said base, a heat-insulating cover which covers the top surface of said base, a handle unit connected to said heat-insulating cover at the top rear portion thereof, a water tank for supplying water to said evaporation chamber removably mounted on the top front portion of said heat-insulating cover from the front thereof, a covering portion provided on said handle unit for covering the upper surface of said water tank, a support post projecting toward said water tank disposed between said heat-insulating cover and said covering portion of said handle unit, a pressing member for normally pressing said water tank forward by a spring pressure provided on said support post or said water tank, and lock means being disposed between said water tank and said covering portion for preventing said water tank form being pushed out forward by said pressing member.

9. A steam iron according to claim 8, wherein said lock means are constituted by an engagement pin and an engagement groove adapted to be engaged with each other when the water tank is moved rearward along the heat-insulating cover or the covering portion.

10. A steam iron according to claim 9, wherein said engagement pin is so constructed as to be disengaged from the engagement groove when a slide lever disposed at one lateral side of the water tank is pressed.

11. A steam iron according to claim 10, wherein a changeover lever for opening and closing the nozzle through which water in the water tank is supplied into the evaporation chamber is disposed at the other lateral side of the water tank opposite to said one lateral side thereof where the slide lever is disposed, said nozzle being adapted to be closed when said changeover lever is pressingly operated.

* * * * *